US008588644B2

(12) United States Patent
Nakajima

(10) Patent No.: US 8,588,644 B2
(45) Date of Patent: Nov. 19, 2013

(54) DEVELOPING DEVICE

(75) Inventor: Keigo Nakajima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 238 days.

(21) Appl. No.: 13/053,474

(22) Filed: Mar. 22, 2011

(65) Prior Publication Data

US 2011/0236058 A1 Sep. 29, 2011

(30) Foreign Application Priority Data

Mar. 24, 2010 (JP) ..... 2010-068579

(51) Int. Cl.
*G03G 15/08* (2006.01)

(52) U.S. Cl.
USPC ..... 399/103; 399/119

(58) Field of Classification Search
USPC ..... 399/103, 119
See application file for complete search history.

(56) References Cited

U.S. PATENT DOCUMENTS

| | | | | |
|---|---|---|---|---|
| 6,205,305 | B1 | 3/2001 | Suzuki et al. | |
| 8,295,731 | B2 | 10/2012 | Noh | |
| 2001/0033757 | A1 | 10/2001 | Sato | |
| 2006/0251445 | A1* | 11/2006 | Ueno et al. | 399/102 |
| 2008/0181659 | A1 | 7/2008 | Noh | |
| 2009/0180816 | A1 | 7/2009 | Sato et al. | |
| 2010/0092206 | A1* | 4/2010 | Matsushita et al. | 399/103 |

FOREIGN PATENT DOCUMENTS

| | | | |
|---|---|---|---|
| CN | 2898877 | Y | 5/2007 |
| CN | 101236387 | A | 8/2008 |
| JP | 2000-019841 | A | 1/2000 |
| JP | 2004-125930 | A | 4/2004 |
| JP | 2009-168993 | A | 7/2009 |

OTHER PUBLICATIONS

CN OA Nov. 5, 2012, CN App 201110072664.5, English translation.

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

A developing device including a first frame including a first welding surface and a second frame including a second welding surface, wherein the first frame and the second frame are welded so that the first welding surface and the second welding surface are opposite to each other, and wherein the developing device further includes: a seal member that is adhered to a first adhesion surface of the first frame and a second adhesion surface of the second frame, wherein the seal member covers a first side end portion from a first side in an orthogonal direction at an opposite part, where the first welding surface and the second welding surface are disposed opposite one another; and a filling agent that is filled between the seal member and the first side end portion in the orthogonal direction at the opposite part.

11 Claims, 10 Drawing Sheets

DEVELOPING DEVICE

CROSS-REFERENCE TO RELATED APPLICATION

This application claims priority from Japanese Patent Application No. 2010-068579 filed on Mar. 24, 2010, the entire subject matter of which is incorporated herein by reference.

BACKGROUND

1. Technical Field

The present invention relates to a developing device that is provided to an image forming apparatus such as laser printer.

2. Background

In an image forming apparatus, it is known a related printer including a process cartridge, which has a drum cartridge holding a photosensitive drum and a developing cartridge holding a developing roller and removably mounted to the drum cartridge, is removably mounted.

As the developing cartridge mounted to the printer, a developing cartridge has been provided to which a lower frame holding a developing roller and an upper frame assembled to the lower frame are welded.

In the developing cartridge, the upper frame has a main body part having a plate shape and a beam-shaped part mounted to a front end of the main body part, and a welding rib to be welded to upper surfaces of a left sidewall, a right sidewall and a rear sidewall of the lower frame is formed at a periphery of a lower surface of the main body part. In other words, the welding rib is continuously formed on the lower surfaces of left, right and rear end portions of the main body part, and the welding rib has a substantial U shape having an opened front side.

When welding the upper and lower frames, a second seal member, which is to be squashed by front end portions of the welding rib, is sandwiched between the beam-shaped part of the upper frame and the left-and-right sidewalls of the lower frame, and then a second seal member is welded together with the front end portions of the welding rib.

In addition, when the upper frame and the lower frame are welded to each other, a front side end of the beam-shaped part of the upper frame is substantially flush with front end of the left-and-right sidewalls of the lower frame.

A first seal member is adhered to straddle over both the front side end of the beam-shaped part of the upper frame and the front end of the left-and-right sidewalls of the lower frame.

The second seal member suppresses toner leakage from between the beam-shaped part of the upper frame and the left-and-right sidewalls of the lower frame. The first seal member suppresses toner leakage from between the front side end of the beam-shaped part of the upper frame and the front face of the left-and-right sidewalls of the lower frame.

SUMMARY

According to the developing cartridge disclosed in the related art, after sandwiching the second seal member, the upper frame and the lower frame are welded. Accordingly, after welding the upper frame and the lower frame, it is not possible to check whether the second seal member is securely adhered.

Therefore, if the adhesion position of the second seal member is out of position or an error is caused leftward and rightward during the welding and thus a gap is formed between the first seal member and the second seal member, toner may be leaked from between the front end portion of the welding rib and the second seal member or between the second seal member and the first seal member.

An object of the present invention is to provide a developing device capable of securely sealing end portions of welding surfaces of a first frame and a second frame.

In order to achieve the above object, a developing device including a housing and a developer carrier, which is carrying developer, wherein the housing comprises a first frame and a second frame that is welded to the first frame, wherein the first frame comprises: a sidewall, which is configured by a pair of the sidewalls that face each other with an interval in a longitudinal direction of the developer carrier therebetween, wherein the sidewall extends in a direction perpendicular to the longitudinal direction and in a direction from the first frame to the second frame, wherein a orthogonal direction is perpendicular to both the longitudinal direction and the extending direction, and wherein each of three direction has a first side and a second side that is opposite to the first side; a connection wall configured to be open at both a first side in the extending direction at the sidewalls and a first side in the orthogonal direction at the sidewalls, wherein the connection wall connects a second side end portion in the extending direction at the sidewall and connects a second side end portion in the orthogonal direction at the sidewall, wherein the first frame includes: a first welding surface that is to be welded to the second frame, wherein the first welding surface is configured to extend to a first side end portion in the orthogonal direction at the sidewalls and is continuously formed on: a first side end surface in the extending direction at the sidewalls; and a first side end surface in the extending direction at the connection wall that connects the second side end portion in the orthogonal direction at the sidewall; and a first adhesion surface that is continuously formed with a first side end portion in the orthogonal direction at the first welding surface, wherein the first adhesion surface extends in the extending direction and is opposite to the developer carrier in the orthogonal direction, wherein the second frame includes: a second welding surface that is formed to correspond to the first welding surface and is to be welded to the first welding surface; and a second adhesion surface that is continuously formed with a first side end portion in the orthogonal direction at the second welding surface, and wherein the second adhesion surface is substantially flush with the first adhesion surface when the second frame is welded to the first frame, and wherein the first frame and the second frame are welded so that the first welding surface and the second welding surface are opposite to each other in the extending direction, and wherein the developing device further comprising: a seal member that is adhered to the first adhesion surface and the second adhesion surface, wherein the seal member covers a first side end portion from the first side in the orthogonal direction at a opposite part, where the first welding surface and the second welding surface are disposed opposite one another; and a filling agent that is filled between the seal member and the first side end portion in the orthogonal direction at the opposite part.

According to the present invention, the first frame and the second frame are welded so that the first welding surface and the second surface are opposite to each other.

The seal member is adhered to the first adhesion surface and the second adhesion surface so that the seal member covers the first end portion from the first side in the orthogonal direction at the opposite part, where the first welding surface and the second welding surface are disposed one another. At this time, the filling agent is filled between the seal member and the first end portion in the orthogonal direction at an opposite part, where the first welding surface and the second welding surface are disposed opposite one another.

Therefore, after welding the first welding surface and the second welding surface, it is possible to provide the filling agent between the seal member and the first end portion in the orthogonal direction at the opposite part, where the first welding surface and the second welding surface is disposed opposite one another.

Accordingly, it is possible to securely position the filling agent between the seal member and the first end portion in the orthogonal direction at the opposite part.

In addition, even when an error is caused in the longitudinal direction during the welding operation, it is possible to securely provided the filling agent between the seal member and the first end portion in the orthogonal direction at the opposite part of the first welding surface and the second welding surface, so as to correspond to the error.

As a result, it is possible to securely seal between the seal member and the first end portion in the orthogonal direction at a opposite part, where the first welding surface and the second welding surface is disposed opposite one another, so that it is possible to securely seal the end portions of the welding surfaces of the first frame and the second frame.

BRIEF DESCRIPTION OF THE DRAWINGS

FIG. 6 is the frame shown in FIG. 2, where

DESCRIPTION OF PREFERRED ILLUSTRATIVE ASPECTS

1. Overall Configuration of Laser Printer

Figure 1:
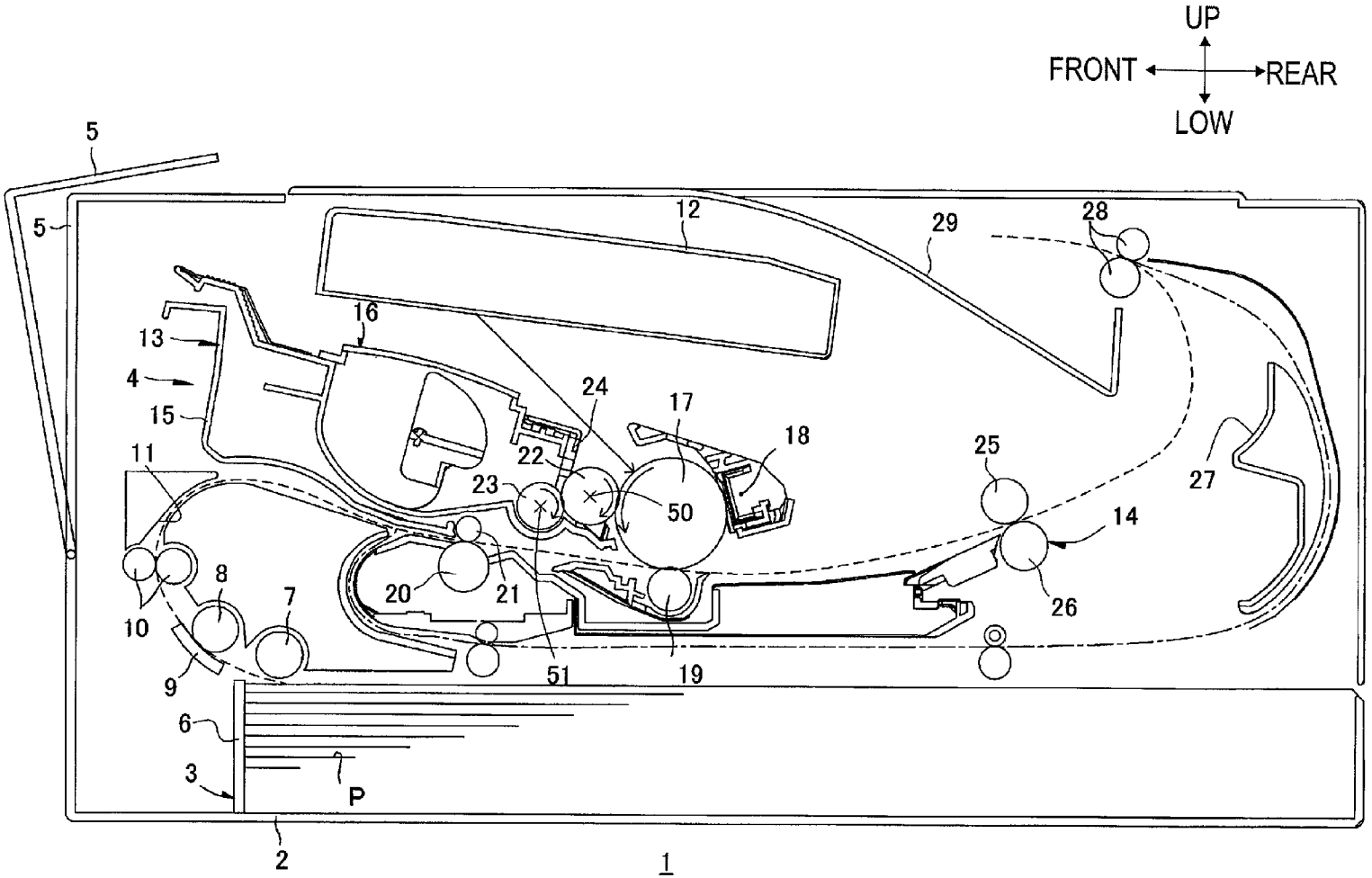
FIG. 1 is a side sectional view showing an illustrative aspect of a printer.

As shown in FIG. 1, a printer 1 includes a feeder unit 3 to feed sheets P and an image forming unit 4 to form an image on the fed sheet P, in a main body casing 2.

(1) Main Body Casing

The main body casing 2 has a substantially rectangular box shape as viewed from a side and houses the feeder unit 3 and the image forming unit 4, and a front cover 5 is formed at the first sidewall for mounting and unmounting to a process cartridge 13, which will be described later. The front cover 5 is provided to the main body casing 2 so as to be rotatable relative to a lower end portion serving as a support point.

In the below descriptions, a side (left side in FIG. 1) to which the front cover 5 is provided is referred to as an front side, and an opposite side (right side in FIG. 1) is referred to as a rear side. In addition, a left side and a right side are set as viewed from the front side of the printer 1. In other words, the near side in FIG. 1 on the paper is the right side, and the far side in FIG. 1 on the paper is the left side. In the meantime, the left-right direction is the same as a longitudinal direction of a developing roller 22 (which will be described later).

(2) Feeder Unit

The feeder unit 3 is provided at a lower part of the main body casing 2. The feeder unit 3 includes a sheet feeding tray 6 that receives sheets P therein, a pickup roller 7 that is provided above a front end portion of the sheet feeding tray 6 and a separation roller 8 and a separation pad 9 that are opposite to each other at the front side of the pickup roller 7. In addition, the feeder unit 3 includes a pair of feeder rollers 10 that are opposite to each other above the separation pad 9, a sheet feeding path 11 that extends from the opposite portion of the feeder rollers 10 in a substantially rear-upper direction and a main body-side register roller 20 that is arranged at the rear of the sheet feeding path 11.

The sheets P are stacked in the sheet feeding tray 6. The uppermost sheet P is fed to the opposite portion between the separation roller 8 and the separation pad 9 by rotation of the pickup roller 7. The sheets are separated one by one by the separation roller and the separation pad. Then, the sheet P passes through the sheet feeding path 11 by conveyance of the feeder rollers 10, is conveyed between the main body-side register roller 20 and a process-side register roller 21 (which will be described later) and is then conveyed toward between a photosensitive drum 17 (which will be described later) and a transfer roller 19 (which will be described later).

(3) Image Forming Unit

The image forming unit 4 includes a scanner unit 12, a process cartridge 13 and a photographic fixing unit 14.

(3-1) Scanner Unit

The scanner unit 12 is provided at an upper part of the main body casing 2. The scanner unit 12 emits laser beam toward the photosensitive drum 17 (which will be described later), based on image data and exposes the photosensitive drum 17 (which will be described later), as illustrated by the solid line in FIG. 1.

(3-2) Developing Unit (3-2-1) Configuration of Developing Unit

The process cartridge 13 is removably mounted below the scanner unit 12 and above the feeder unit 3 in the main body casing 2, and the process cartridge 13 has a drum cartridge 15 and a developing cartridge 16 that is an example of a developing device removably mounted to the drum cartridge 15.

The drum cartridge 15 has the photosensitive drum 17, a scorotoron-type charger 18 and the transfer roller 19.

The photosensitive drum 17 is provided at a rear end portion of the drum cartridge 15 along with the left-right direction.

The scorotron-type charger 18 is arranged to be opposite to the photosensitive drum 17 having with an interval therebetween, in the rear-upper side of the photosensitive drum 17.

The transfer roller 19 is arranged to be opposite to a lower side of the photosensitive drum 17 and is press-contacted to the lower side of the photosensitive drum 17.

In addition, the drum cartridge 15 has the process-side register roller 21.

The process-side register roller 21 is provided to contact an upper side of the main body-side register roller 20 at a substantially middle lower end portion in the front-rear direction at the drum cartridge 15.

The developing cartridge 16 has the developing roller 22 that is an example of a developer carrier.

The developing roller 22 is extended in the left and right direction and is rotatably supported at the rear end portion of the developing cartridge 16 so that it is exposed from the rear side thereof. The developing roller 22 is press-contacted to the front side of the photosensitive drum 17.

In the meantime, the developing cartridge 16 has a supply roller 23 that supplies toner to the developing roller 22 and a layer thickness regulating blade 24 that regulates a thickness of toner supplied to the developing roller 22. Toner that is an example of developer is accommodated in a front space of the supply roller and the blade.

(3-2-3) Developing Operation in Developing Unit

The toner in the developing cartridge 16 is supplied to the supply roller 23 and the developing roller 22 and is positively friction-charged between the supply roller 23 and the developing roller 22.

A thickness of toner supplied to the developing roller 22 is regulated by the layer thickness regulating blade 24, as the developing roller 22 is rotated. The toner is carried on a surface of the developing roller 22, as a thin layer having a predetermined thickness.

In the meantime, a surface of the photosensitive drum 17 is positively charged uniformly by the scorotron-type charger 18 as the photosensitive drum 17 is rotated. Then a surface of the photosensitive drum 17 is exposed by high-speed scanning of the laser beam from the scanner unit 12 (refer to the solid line in FIG. 1). Accordingly, an electrostatic latent image that corresponds to an image to be formed on the sheet P is formed on the surface of the photosensitive drum 17.

When the photosensitive drum 17 is further rotated, the toner, which is carried on the surface of the developing roller 22 and positively charged, is supplied to the electrostatic latent image formed on the surface of the photosensitive drum 17. Thus, the electrostatic latent image of the photosensitive drum 17 becomes a visualized image and a toner image resulting from reversal development is carried on the surface of the photosensitive drum 17.

When the sheet P conveyed between the photosensitive drum 17 and the transfer roller 19 passes through between the photosensitive drum 17 and the transfer roller 19, the toner image carried on the photosensitive drum 17 is transferred on the sheet P.

(3-3) Photographic Fixing Unit

The photographic fixing unit 14 is arranged at the rear of the process cartridge 13, and the photographic fixing unit 14 includes a heating roller 25 and a pressing roller 26 that is opposite to the heating roller 25. In the process cartridge 13, the toner image transferred on the sheet P is heat-fixed on the sheet P by heating and pressing while the sheet P is passing through between the heating roller 25 and the pressing roller 26.

(4) Sheet Discharge Unit

The sheet P, on which the toner image is fixed passes through a sheet discharge path 27, is conveyed toward sheet discharge rollers 28 and is discharged on a sheet discharge tray 29 by the sheet discharge rollers 28, which tray is provided above the scanner unit 12.

2. Details of Developing Cartridge (1) Frame

Figure 2:
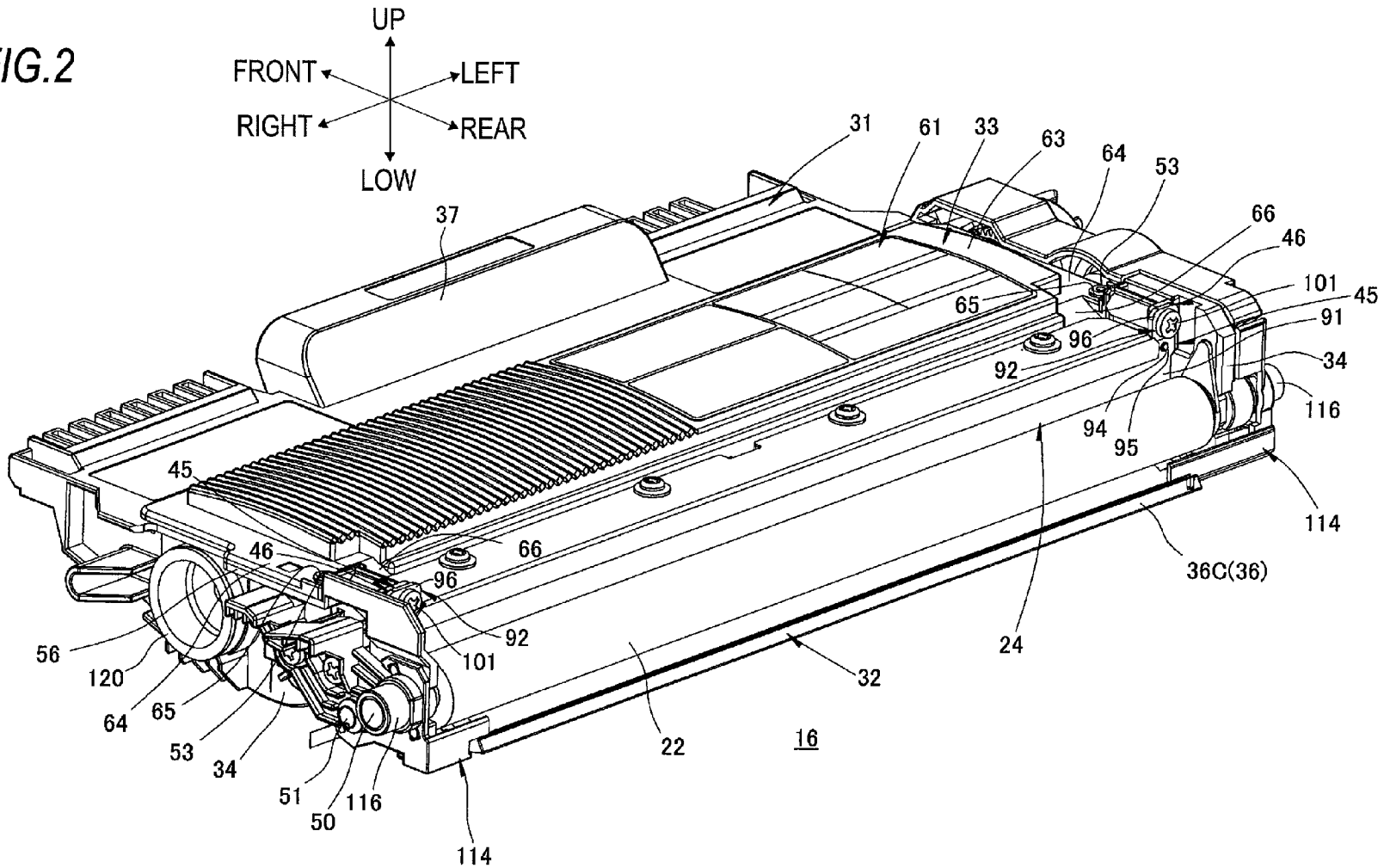
FIG. 2 is a perspective view of a developing cartridge shown in FIG. 1, as viewed from a right-upper direction.

As shown in FIG. 2, the developing cartridge 16 has a substantial box shape extending in the left-right direction and includes a frame 31 that is an example of a housing.

The frame 31 has a substantial box shape extending in the left-right direction and includes both a first frame 32 and a second frame 33.

(1-1) First Frame (1-1-1) Configuration of First Frame

Figure 3:
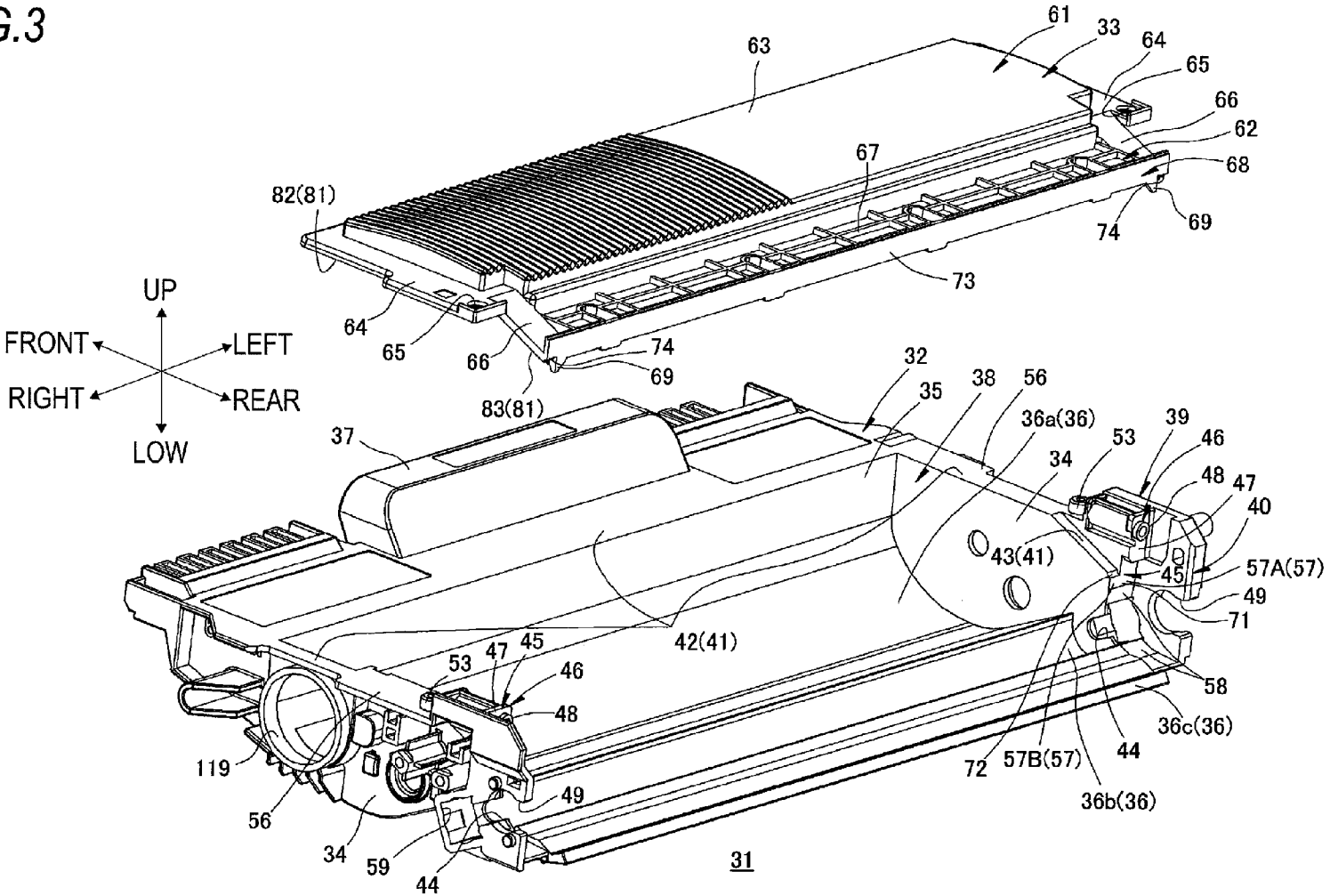
FIG. 3 is an exploded perspective view of a frame shown in FIG. 2, as viewed from a right-upper direction.

As shown in FIG. 3, the first frame 32 configures a lower part of the frame 31 and has a frame shape that is opened upwardly and rearward and has a bottom face. In addition, the first frame 32 integrally has a pair of left-and-right sidewalls 34, a front wall 35 and a lower wall 36.

Both sidewalls 34 have respectively a substantially rectangular shape as viewed from a side face and is extending in the upper-lower direction and elongated in the front-rear direction. The sidewalls 34 are opposite to each other with an interval in the left-right direction. In addition, a toner filling opening 119, which has a substantially circular shape as viewed from a side face, is provided at the right sidewall 34 is formed. The a toner filling opening 119 penetrates the sidewall 34 in the left-right direction at a position corresponding to a toner accommodating part 38 (which will be described later).

The front wall 35 has a substantially rectangular shape extending in the left-right direction as viewed from a front face, the front wall 35 connects front end portions of both sidewalls 34. In addition, the front wall 35 has an operation part 37 that extends toward the front from an upper end portion of the front wall. The operation unit 37 is held by a user when the user operates the developing drum 16 (for example, mounting and unmounting operation to and from the drum cartridge 15).

The lower wall 36 is continuously formed with a lower end portion of the front wall 35 with extending rearward from the lower end portion of the front wall 35 and connects lower end portions of both sidewalls 34. In other words, the lower wall 36 configures a connection wall that connects both sidewalls 34, together with the front wall 35. In addition, the lower wall 36 integrally has a first part **36*a* that configures a toner accommodating part 38 (which will be described later), a second part 36*b* that configures a supply roller support part 39 (which will be described later) and a third part 36*c* that configures a developing roller support part 40** (which will be described below).

The first part **36*a* is provided at a substantial middle in the front-rear direction at the first frame 32. The first part 36*a* has a shallow circular arc shape having an opened upper side as viewed from a side sectional view. Specifically, the first part 36*a* is continuously formed with the lower end portion of the front wall 35. The first part 36*a*** is first downwardly bent toward the rear and is then upwardly inclined toward the rear.

The second part **36*b* has a substantial U-shape having an opened upper side as viewed from a side sectional view. The second part 36*b* is continuously formed with a rear end portion of the first part 36*a* and bents along a circumferential surface of the supply roller 23**.

The third part **36*c* has a substantially linear shape (lip shape) as viewed from a side sectional view. The third part 36*c* is continuously formed with a rear end portion of the second part 36*b*** and extending toward the rear.

A part surrounded by the sidewalls 34, the front wall 35 and the first part **36*a* is defined as the toner accommodating part 38 that accommodates toner therein. In the toner accommodating part 38, an upper end surface of the front wall 35 is formed into a surface that is substantially flush with upper end surfaces of the sidewalls 34. In addition, the toner accommodating part 38 has flange parts 56 and second frame positioning bosses 53**.

The flange parts 56 have a substantially plate shape extending in the front-rear direction to protrude outward in the left-right direction from upper ends of sidewalls 34 of the toner accommodating part 38, respectively.

The second frame positioning bosses 53 have a substantially cylindrical shape protruding upwardly from the upper end surfaces of the sidewalls 34 and the flange parts 56, in the rear end portions of the toner accommodating part 38.

In addition, a part surrounded by the sidewalls 34 and the second part 36*b* is defined as the supply roller support part 39. The supply roller support part 39 includes step portions 45, guide recesses 44 and shaft seal fitting parts 59.

The step portion 45 is provided at a substantial middle in the front-rear direction at the sidewall 34 of the supply roller support part 39, and the step portion 45 is formed so that a rear half part thereof is inwardly recessed in the left-right direction with respect to a front half part thereof.

In addition, the step portion 45 is provided with a blade fixing part 46, a first adhesion part 57 and a side seal adhesion part 58.

The blade fixing part 46 is provided at an outward half part in the left-right direction at the sidewall 34. The blade fixing part 46 has a substantially rectangular shape as viewed from a front face and slightly protrudes toward the rear from a rear end surface of the step portion 45. In addition, the blade fixing part 46 has a support surface 47 extending in the upper-lower direction and a blade positioning boss 48 protruding from the support surface 47 toward the rear. The blade positioning boss 48 has a substantially cylindrical shape to which a screw 101 (which will be described below) can be engaged.

The first adhesion part 57 is provided at a lower side of the blade fixing part 46 and has a substantial L shape as viewed from a rear side. Specifically, the first adhesion part 57 has an outside portion 57A that extends in the upper-lower direction at an outward half part in the left-right direction at the sidewall 34 and an inside portion 57B that protrudes inwardly in the left-right direction from a lower end portion of the outside portion 57A. In addition, the first adhesion part 57 includes a first adhesion surface 71.

The first adhesion surface 71 is a rear end surface of the first adhesion part 57 and is a planar surface having a substantial L shape extending in the upper-lower-left-right direction, as viewed from a rear side.

The side seal adhesion part 58 is bent rearward toward the lower. The side seal adhesion part 58 is continuously formed with the lower end portion of the first adhesion part 57 and to follow the circumferential surface of the developing roller 22.

The guide recess 44 is provided at a substantial middle in the upper-lower direction at the side seal adhesion part 58. The guide recess 44 is notched from a rear end surface of the side seal adhesion part 58 toward a front-lower side and has a substantial U-shape as viewed from a side face that is opened in a rear-upper direction. A recess width of the guide recess 44 (a length in the front-upper and rear-lower direction) is formed to be wider than a diameter of a supply roller shaft 51 of the supply roller 23.

The shaft seal fitting part 59 is arranged to overlap with a substantially middle portion in the upper-lower direction at the side seal adhesion part 58, when projected in the left-right direction, and the shaft seal fitting part 59 is formed into a substantially rectangular shape caved inwardly in the left-right direction, as viewed from a side face, from an outer surface in the left-right direction at the frame 31 to the vicinity of an inside end portion in the left-right direction in the side seal adhesion part 58. In addition, the shaft seal fitting part 59 has a rear end portion that is arranged more rearward than a rear end surface of the side seal adhesion part 58, when projected in the left-right direction. In other words, the rear end portion of the side seal adhesion part 58, which is overlapped with the shaft seal fitting part 59, is notched from the rear end surface toward a front-lower side. In addition, the shaft seal fitting part 59 is arranged so that a front end portion of the guide recess 44 is arranged at a substantial middle of the shaft seal fitting part, when projected in the left-right direction.

In addition, a part surrounded by the sidewalls 34 and the third part 36*c* is defined as the developing roller support part 40. In addition, the sidewalls 34 of the developing roller support part 40 are continuously formed with the rear side half parts of the sidewalls 34 of the supply roller support part 39 and are formed to have the same thickness (a length in the left-right direction) as the rear side half parts of the sidewalls 34 of the supply roller support part 39, respectively. The sidewalls 34 at the developing roller support part 40 include developing roller support recesses 49.

The developing roller support recess 49 has a substantial U-shape, as viewed from a side face, that is opened rearward and notched from the rear end portion of the sidewall 34 toward the front side. A recess width (a length of the upper-lower direction) of the developing roller support recess 49 is formed to be wider than a diameter of a developing roller shaft 50 of the developing roller 22.

(1-1-2) Configuration about Welding in First Frame

The first frame 32 has a first welding surface 41 and first notch portions 72.

The first welding surface 41 includes the upper end surfaces of the sidewalls 34 and the upper end surface of the front wall 35, and the first welding surface 41 has a first receiving-part-side welding surface 42 and a first support part-side welding surface 43, which configures a pair of first support part-side welding surfaces 43.

The first receiving-part-side welding surface 42 has the upper end surface of the front wall 35 and the upper end surfaces of the sidewalls 34, which are corresponding to the toner accommodating part 38, and first receiving-part-side welding surface 42 is formed into a substantial U-shape having an opened rear side as viewed from a plan view.

The first support part-side welding surfaces 43 are continuously formed with the rear end portions of the first receiving-part-side welding surface 42 and are respectively formed as inside half parts in the left-right direction at the upper end surfaces of the sidewalls 34 (i.e., insides in the left-right direction with respect to the blade fixing parts 46). In addition, the first support-side welding surfaces 43 are inclined downward toward the rear and have rear end portions that continues to upper end portions of the inside portions 57B of the first adhesion parts 57.

In other words, the first welding surface 41 is continuously formed at the upper end surfaces of the sidewalls 34 and the upper end surface of the front wall 35 so that it extends to the rear end portions of the sidewalls 34.

The first notch portions 72 are notched from the first adhesion surfaces 71 toward the front side, at upper end portions (i.e., portions at which the first adhesion surfaces 71 and the first support-side welding surfaces 43 are continuous) of the inside portions 57B of the first adhesion parts 57. Thus, the first notch portions 72 have respectively a partially cylindrical shape having a substantial sector shape being opened rear side and upper side (refer to FIG. 6B), as viewed from a side sectional face.

In addition, the first frame 32 has bearing parts 52.

Figure 7:
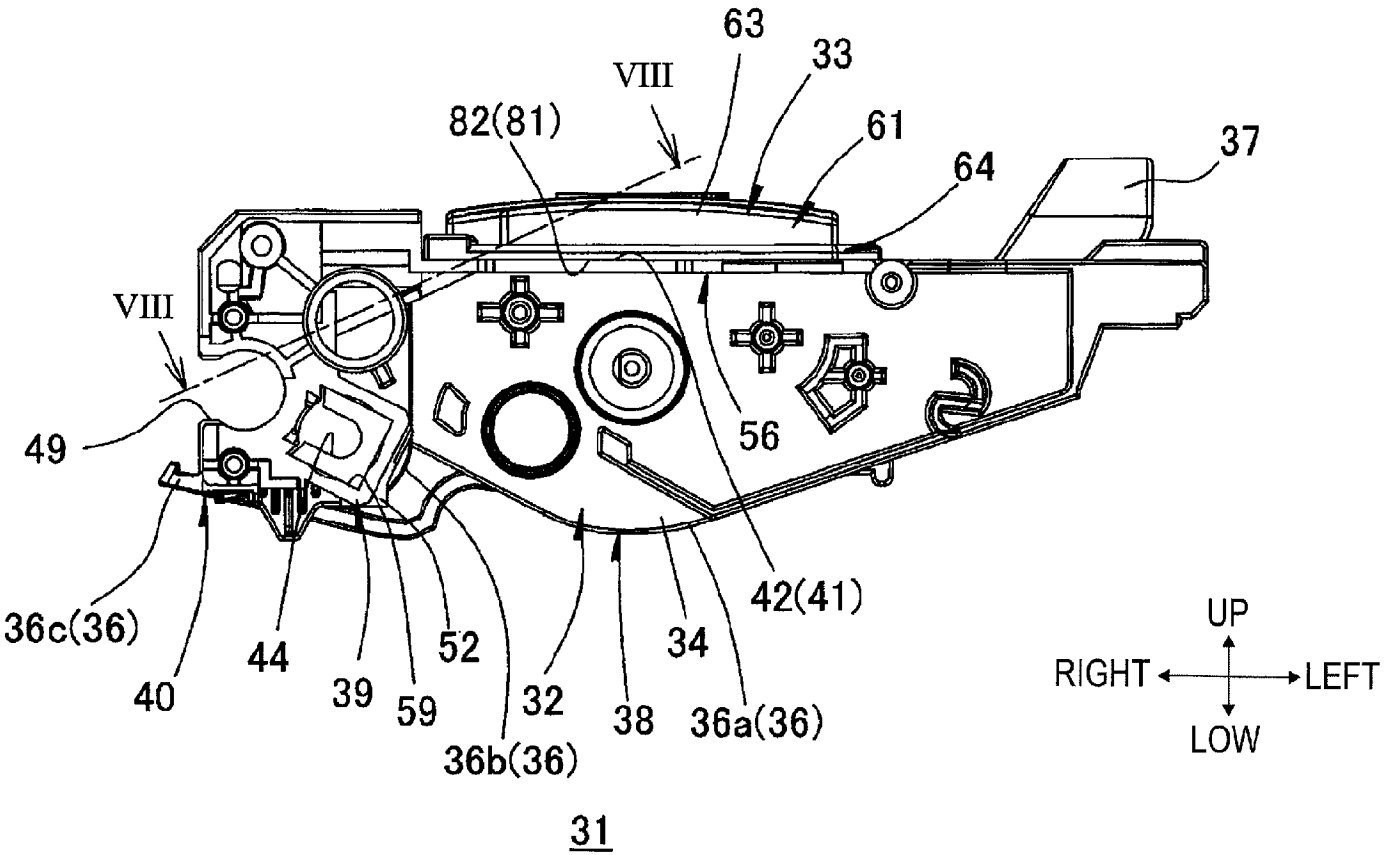
FIG. 7 is a left side view of the frame shown in FIG. 2.
Figure 8:
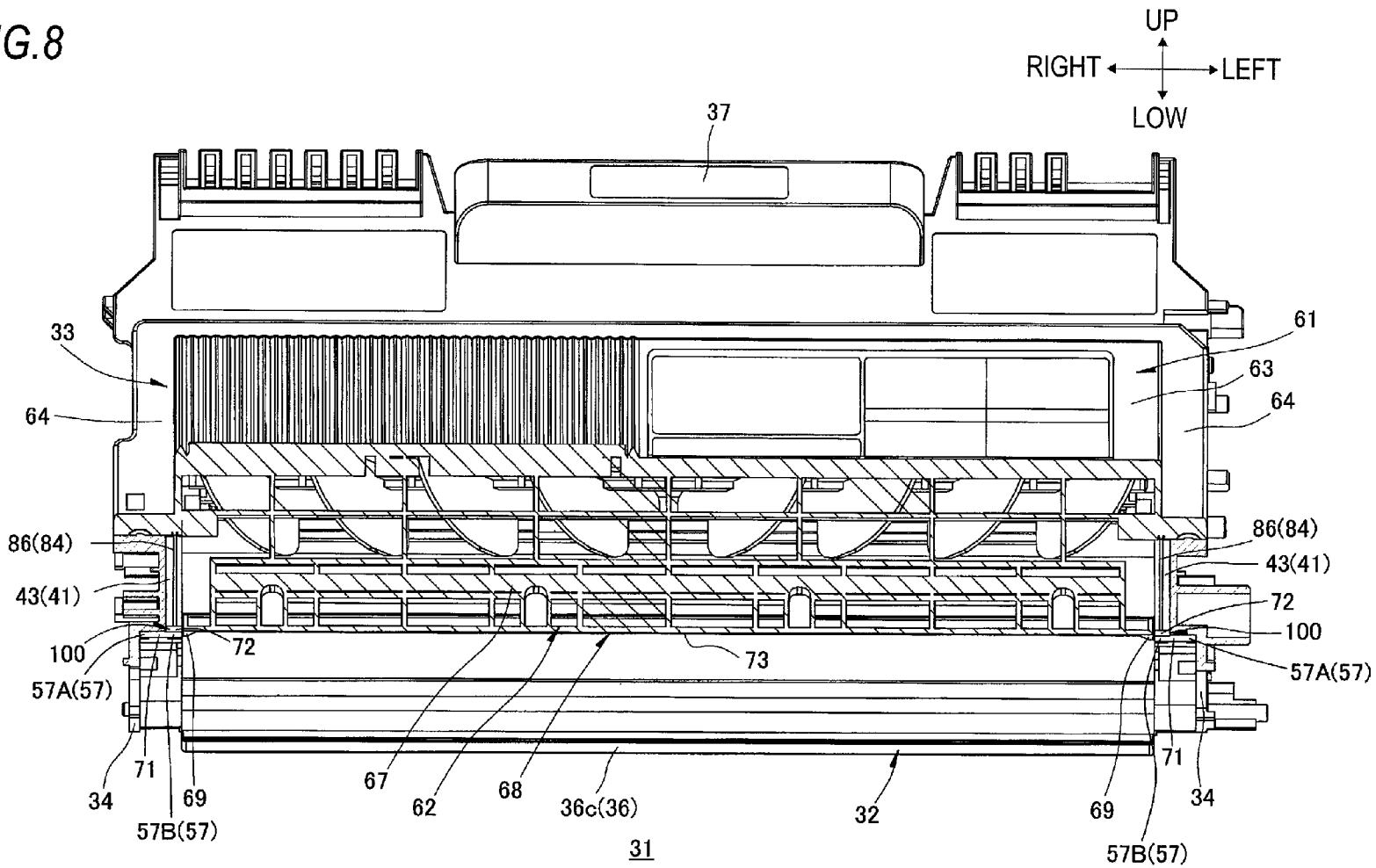
FIG. 8 is a sectional view taken along a line VIII-VIII of FIG. 7.

The bearing parts 52 are respectively provided at the lower end portions of the supply roller support part 39 of the sidewalls 34. In addition, the bearing parts 52 are arranged below the rear end portions of the first support part-side welding surfaces 43. Additionally, lower end surfaces of the bearing parts 52 extend in a flat plate shape along the front-rear direction (refer to FIG. 7), respectively.

(1-2) Second Frame (1-2-1) Configuration of Second Frame

Figure 4:
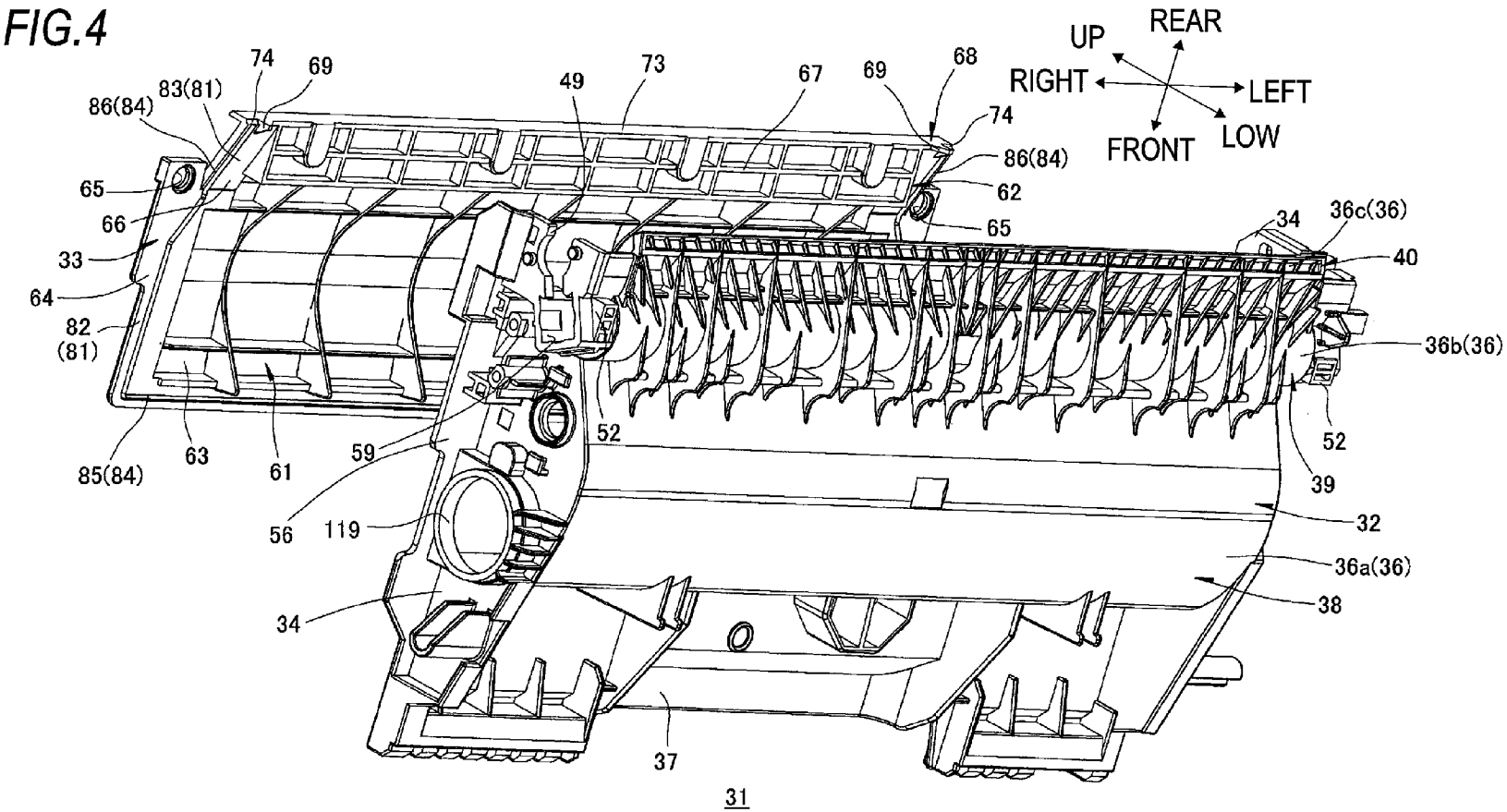
FIG. 4 is an exploded perspective view of the frame shown in FIG. 2, as viewed from a right-lower direction.

As shown in FIGS. 3 and 4, the second frame 33 configures an upper part of the frame 31 and has a substantially rectangular flat plate shape as viewed from a plan view.

In addition, the second frame 33 integrally has a toner accommodating part-covering part 61 that covers the toner accommodating part 38 of the first frame 32 from its upper side and a supply roller-covering part 62 that covers the supply roller 23 from its upper side.

The toner accommodating part-covering part 61 has a substantially rectangular flat plate shape having a size capable of completely covering the toner accommodating part 38 of the first frame 32, as viewed from a plan view. In addition, the toner accommodating part-covering part 61 has an expanding part 63 and a first contact part 64.

The expanding part 63 is formed to protrude upward at a central part of the toner accommodating part-covering part 61. In addition, a plurality of ribs is provided at lower surface of the expanding part 63, and the plurality of ribs extend in the front-rear direction, protrude downward from the lower surface of the expanding part 63 and are arranged in parallel with each other with an equal interval in the left-right direction.

The first contact part 64 is provided at left and right sides and a rear side of the expanding part 63 to surround the expanding part 63, and the first contact part 64 has a substantially U-shaped flat plate shape that is opened toward the rear side so as to correspond to the first receiving-part-side welding surface 42 of the first frame 32, as viewed from a plan view. In addition, the first contact part 64 includes a pair of left and right positioning holes 65.

Both positioning holes 65 are respectively formed at left and right rear end portions of the first contact parts 64 and have respectively a substantially circular shape capable of receiving the frame positioning bosses 53 of the first frame 32, as viewed from a plan view.

The supply roller-covering part 62 has a substantially rectangular flat plate shape extending from the rear end portion of the toner accommodating part-covering part 61 toward the rear, as viewed from a plan view. In addition, the supply roller-covering part 62 has a pair of second left and right contact parts 66, a reinforcement part 67, a second adhesion part 68 and damming portions 69.

Both second contact parts 66 are respectively provided with an interval at left and right end portions of the supply roller-covering part 62. In addition, the second contact parts 66 is continuously formed with rear end portions of the first contact part 64 and have respectively a flat plate shape that is inclined downward toward the rear so as to correspond to the first support-side welding surfaces 43 of the first frame 32.

The reinforcement part 67 extends rearward from a rear lower end portion of the toner accommodating part-covering part 61 in between the second contact parts 66. The reinforcement part 67 has ribs extending in the front-rear or left-right direction.

The second adhesion part 68 has a flat plate shape that extends in the upper-lower-left-right direction and extends long in the left-right direction at a rear end portion of the reinforcement part 67. The second adhesion part 68 is connected to the reinforcement part 67 at a substantial middle of the upper-lower direction at the second adhesion part, and the second adhesion part 68 is connected to both the second contact parts 66 at lower end portions of both left and right end portions thereof. In addition, the second adhesion part 68 has a second adhesion surface 73.

The second adhesion surface 73 is a rear end surface of the second adhesion part 68 and is a planar surface that extends in the upper-lower-left-right direction and is long in the left-right direction. The second adhesion surface 73 is formed in such a way that it is substantially flush with the first adhesion surfaces 71 when the first frame 32 and the second frame 33 are assembled.

The damming portions 69 protrude downward from a lower side end of the second adhesion part 68. The damming portions 69 have a substantially triangular shape having a vertex directed downward as viewed from a back face and are arranged adjacent to inner sides in the left-right direction at second notch portions 74 (which will be described below). An outer end in the left-right direction at each of the damming portions 69 is substantially linear in the upper-lower direction.

(1-2-2) Configuration about Welding in Second Frame

The second frame 33 has a second welding surface 81 and second notch portions 74.

The second welding surface 81 includes lower surfaces of the first contact part 64 and the second contact parts 66, and the second welding surface 81 is formed to correspond to the first welding surface 41. In addition, the second welding surface 81 has a second receiving-part-side welding surface 82 and second support part-side welding surfaces 83.

The second receiving-part-side welding surface 82 is provided on the lower surface of the first contact part 64 and is formed into a substantial U-shape having an opened rear side as viewed from a bottom face, which is corresponding to the first receiving-part-side welding surface 42.

The second support part-side welding surfaces 83 is provided on the lower surfaces of the second contact parts 66 and extend downward toward the rear, which is corresponding to the first support part-side welding surfaces 43.

The second notch portions 74 are respectively formed notched from the second adhesion surface 73 toward the front side at lower end portions (i.e., portions at which the second adhesion surface 73 and the second support-side welding surfaces 43 are continuous) of end portions of the second adhesion part 68. The second notch portions 74 is formed into a partially cylindrical shape having a substantial sector shape having opened rear side and upper side (refer to FIG. 6B), as viewed from a side end face.

In addition, the second frame 33 has a welding rib 84.

The welding rib 84 is a ridge that protrudes downward from the second receiving-part-side welding surface 82 and the second support part-side welding surfaces 83, and is provided to surround entire the expanding part 63 and the reinforcement part 67 over both the second receiving-part-side welding surface 82 and the second support part-side welding surfaces 83. The welding rib 84 has a receiving-part-side welding rib 85 provided on the lower surface of the second receiving-part-side welding surface 82 and support part-side welding ribs 86 provided on the lower surfaces of the second support part-side welding surfaces 83.

(2) Other Configurations

The developing cartridge 16 as described above includes the layer thickness regulating blade 24. The layer thickness regulating blade 24 includes a blade member 91 that contacts the developing roller 22 and a support member 92 that supports the blade member 91.

The blade member 91 is formed by a thin metal plate, etc., having elasticity, and the blade member 91 has a substantially rectangular flat plate shape extending in the left-right direction, as viewed from a front face. In addition, penetrated holes 94 that penetrate the blade member 91 in a thickness direction (front-rear direction) thereof are formed at both end portions in the left-right direction of an upper end portion of the blade member 91.

The support member 92 is formed by a metal plate thicker than the blade member 91, etc., and has a substantially flat plate shape extending in the left-right direction. The support member 92 has convex parts 95 and attachment parts 96.

The convex parts 95 have respectively a substantially cylindrical shape protruding from a rear end surface of the support member to the rear, at both end portions in the left-right direction of the support member 92.

The attachment parts 96 have respectively a substantially rectangular flat plate shape, as viewed from a front face, protruding upwardly from a rear upper end of the support member 92, at both end portions in the left-right direction of the support member 92. In addition, the attachment parts 96 include attachment holes (not shown) that penetrate the attachment parts 96 in a thickness direction (front-rear direction) thereof.

The blade member 91 is attached to the support member 92 so that the convex parts 95 of the support member 92 are inserted into the penetrated holes 94 of the blade member 91 from the front.

In addition, the developing cartridge 16 has bearing members 114 at outer sides in the left-right direction of the developing roller support part 40.

The bearing members 114 integrally have collar parts 116, which have a substantially cylindrical shape having an inner diameter capable of housing the developing roller shaft 50 therein and rotatably support both end portions in the left-right direction of the developing roller shaft 50.

Figure 9:
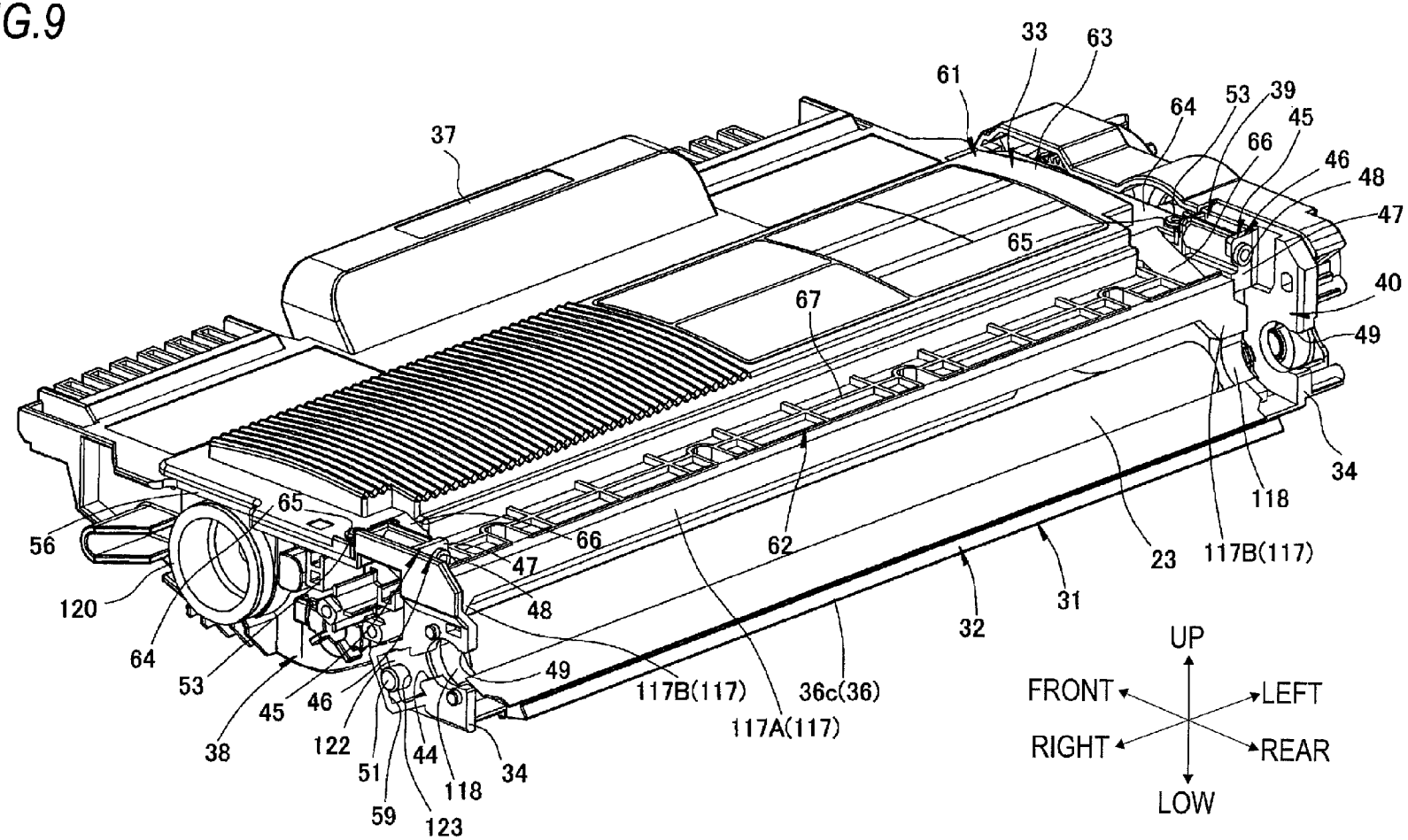
FIG. 9 is a perspective view showing the frame, which is provided a supply roller and a seal member, as viewed from a right-upper direction.

In addition, the developing cartridge 16 includes a seal member 117, a pair of left and right shaft seals 122 and a pair of left and right side seals 118, as shown in FIG. 9.

The seal member 117 is formed by a sponge made of resin, etc., and has a substantially rectangular shape extending in the left-right direction, and the seal member 117 has both end portions protruding downward, as viewed from a rear side. Specifically, the seal member 117 includes a central seal part 117A and end seal parts 117B.

The central seal part 117A has a substantially rectangular shape extending in the left-right direction, as viewed from a rear side, and the central seal part 117A has the substantially same left-right length as the second adhesion surface 73 of the second frame 33 so as to correspond to the second adhesion surface 73.

The end seal parts 117B are continuously formed with both lower end portions in the left-right direction of the central seal part 117A so as to correspond to the first adhesion surfaces 71 of the first frame 32. The end seal parts 117B extend so that they are inclined downward toward out sides.

The shaft seals 122 formed by a sponge made of resin, etc, and have a substantially rectangular cylinder shape corresponding to the shaft seal fitting parts 59, as viewed from a side face. In addition, as viewed from a side face of the shaft seals 122, the shaft seals are formed at substantial middles with supply roller shaft inserting penetration holes 123 that are slightly smaller than the diameter of the supply roller shaft 51. The supply roller shaft 51 is inserted into the supply roller shaft inserting penetration holes 123.

The side seals 118 formed by a sponge made of resin, etc., respectively have a substantial rectangular cylinder shape extending in the upper-lower direction and are adhered to the side seal adhesion parts 58 of the first frame 32.

In addition, the developing cartridge 16 includes a cap 120 for sealing hermetically the toner filling opening 119.

3. Assembling of Developing Cartridge (1) Assembling of Frames

When assembling the developing cartridge 16, the frame 31 is first assembled.

When assembling the frame 31, the second frame 33 is overlapped and welded with the upper end surface of the first frame 32 to cover from the upper side, as shown in FIG. 3.

For overlapping the second frame 33 with the first frame 32, the second frame 33 is positioned above the first frame 32 so that the frame positioning bosses 53 of the first frame 32 are inserted into the positioning holes 65 of the second frame 33 and the reinforcement part 67 of the second frame 33 is arranged between the blade fixing parts 46 of the first frame 32. Then, the second frame 33 is overlapped above the first frame 32.

Figure 5:
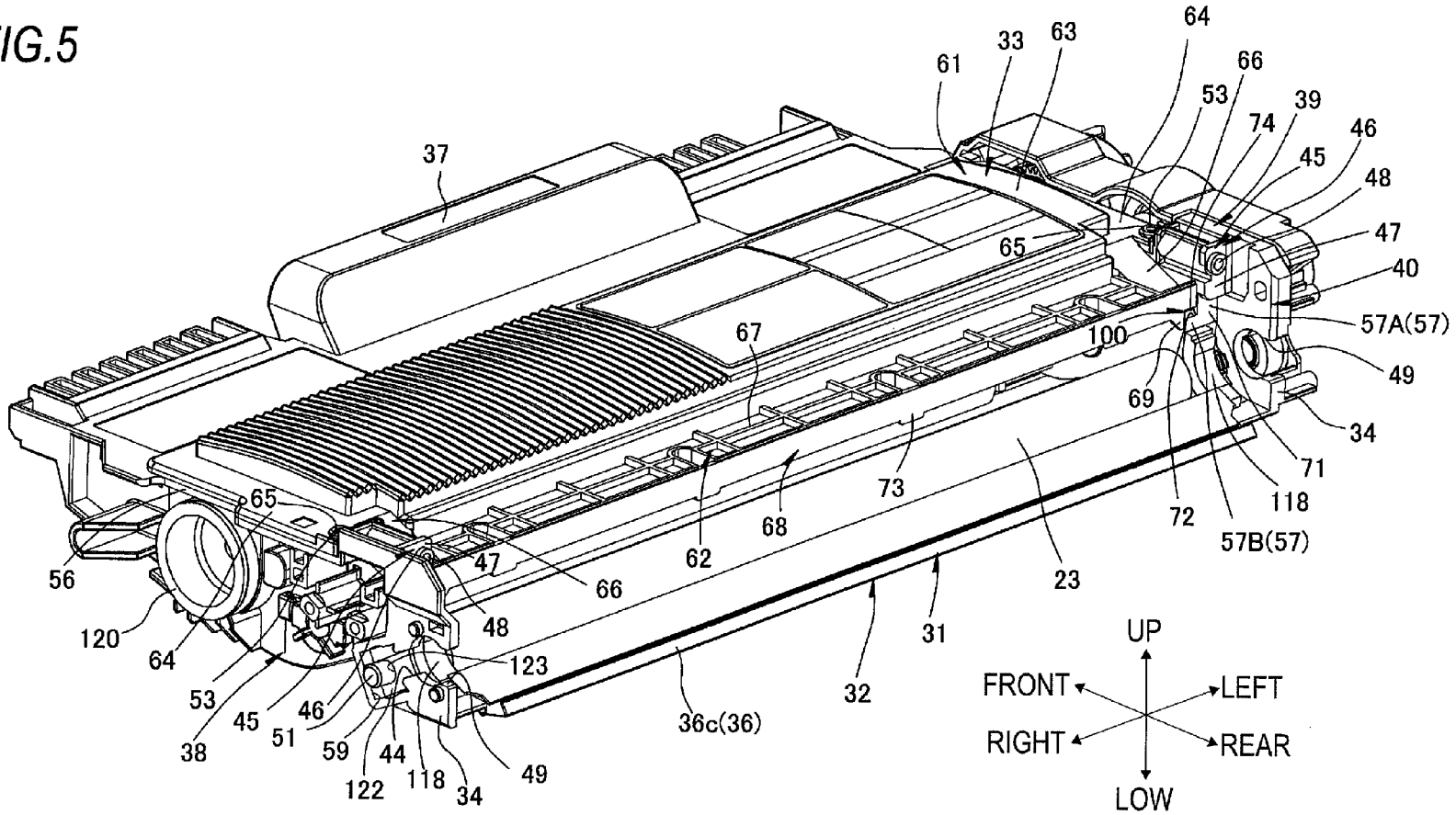
FIG. 5 is a perspective view showing the frame having a supply roller, as viewed from a right-upper direction.

Thus, the frame positioning bosses 53 of the first frame 32 are inserted into the positioning holes 65 of the second frame 33 from the lower side, and the second frame 33 and the first frame 32 are assembled, as shown in FIG. 5.

At this time, the receiving-part-side welding rib 85 of the second frame 33 is contacted to the first receiving-part-side welding surface 42 of the first frame 32 and the receiving-part-side welding ribs 86 of the second frame 33 are contacted to the first support part-side welding surfaces 43 of the first frame 32.

In addition, the first notch portions 72 of the first frame 32 and the second notch portions 74 of the second frame 33 are disposed opposite one another in the upper-lower direction, and the first notch portions 72 and the second notch portions 74 are combined, then recess parts 100 are formed. The recess parts 100 have a partially cylindrical shape being a semicircle as viewed from a side sectional face (refer to FIG. 6B). In front end portions of the recess parts 100, the rear end portions of the second support part-side welding surfaces 83 and the rear end portions of the first support part-side welding surfaces 43 are opposite in the upper-lower direction. In addition, a length of the upper-lower direction of a rear end portion of the recess part 100 is about 1 to 5 mm, for example.

Also, the reinforcement part 67 of the second frame 33 is arranged between the blade fixing parts 46 of the first frame 32. The end portions in the left-right direction of the reinforcement part 67 and the blade fixing parts 46 are opposite one another with a slight interval, respectively.

Specifically, both end portions in the left-right direction of the reinforcement part 67 and the blade fixing parts 46 face one another with an interval of 0.5 to 3 mm, for example.

In addition, the damming portions 69 of the second frame 33 are arranged adjacent to the inner sides in the left-right direction of the first adhesion parts 57 of the first frame 32 so that the damming portions protrude toward the first frame 32. The damming portions 69 and the first adhesion parts 57 are opposite one another with a slight interval, respectively.

Specifically, the damming portion 69 and the first adhesion part 57 are opposite with an interval of about 0.5 to 3 mm, for example.

In the meantime, both end portions in the left-right direction of the reinforcement part 67 and the blade fixing parts 46 form acceptance recesses 102 that communicates with outer end portions in the left-right direction of the recess parts 100 so that the acceptance recesses extend upwardly from upper end portions of the recess parts 100.

In addition, the damming portions 69 and the first adhesion parts 57 form acceptance recesses 102 that communicates with inner end portions in the left-right direction of the recess parts 100 so that the acceptance recesses extend downward from lower end portions of the recess parts 100.

Then, the assembled first frame 32 and second frame 33 are welded.

For welding the first frame 32 and the second frame 33, the second receiving-part-side welding surface 82 of the second frame 33 and the first receiving-part-side welding surface 42 of the first frame 32 are welded, and also the second support part-side welding surfaces 83 of the second frame 33 and the first support part-side welding surfaces 43 of the first frame 32 are also welded.

When welding the second receiving-part-side welding surface 82 of the second frame 33 and the first receiving-part-side welding surface 42 of the first frame 32, the flange parts 56 of the first frame 32 and the first contact parts 64 of the second frame 33 are sandwiched in the upper-lower direction and ultrasonic-welded while pressing them.

Thus, the receiving-part-side welding rib 85 is melted, and the melted receiving-part-side welding rib 85 is pressed and spread in every direction between the second receiving-part-side welding surface 82 and the first receiving-part-side welding surface 42 by the pressing force of sandwiching the flange parts 56 and the first contact parts 64 in the upper-lower direction. Then, the receiving-part-side welding rib 85 is adhered to the first receiving-part-side welding surface 42. After that, the pressed and spread receiving-part-side welding rib 85 is cooled and again solidified, so that the second receiving-part-side welding surface 82 and the first receiving-part-side welding surface 42 are welded to each other.

In addition, the first support part-side welding surfaces 43 of the first frame 32 and the second support part-side welding surfaces 83 of the second frame 33 are also welded. In this case, the assembled first frame 32 and second frame 33 are put on a jig (not shown) of the bearing parts 52 and the ultrasonic is applied while pressing the second contact parts 66 of the second frame 33 from the upper side.

Thus, the support part-side welding ribs 86 are melted, and the melted support part-side welding ribs 86 are pressed and spread in every direction between the second support part-side welding surfaces 83 and the first support part-side welding surfaces 43 by the pressing force to the second contact parts 66. Then, the support part-side welding ribs 86 are adhered to the first support part-side welding surfaces 43.

At this time, the support part-side welding ribs 86, which are pressed and spread rearward, are discharged rearward from between the rear end portions of the second support part-side welding surfaces 83 and the rear end portions of the first support part-side welding surfaces 43, and the melted ribs are introduced into the recess parts 100.

After that, the receiving-part-side welding rib 85 is cooled and again solidified, so that the second support part-side welding surfaces 83 and the first support part-side welding surfaces 43 are adhered to each other. In the meantime, the support part-side welding ribs 86 introduced into the recess parts 100 are solidified in the recess parts 100. In addition, the rear end portions of the solidified support part-side welding ribs 86 are arranged more forward than the rear end portions of the recess parts 100.

Accordingly, the welding of the first frame 32 and the second frame 33 is completed, so that the assembling of the frame 31 is completed.

(2) Assembling of Respective Members to Frame

Then, as shown in FIG. 5, the supply roller 23 is assembled to the frame 31.

The supply roller 23 is assembled to the supply roller support part 39 so that both end portions in the left-right direction of the supply roller shaft 51 are rotatably supported to the guide recesses 44.

Then, the shaft seals 122 are rotatably fitted to both end portions in the left-right direction of the supply roller shaft 51 and fitted into the shaft seal fitting parts 59 of the frame 31 from the outer direction so that the supply roller shaft 51 is inserted into the supply roller shaft inserting penetration holes 123. Then, the side seals 118 are adhered to the side seal adhesion parts 58. At this time, the side seals 118 are contacted to the rear end portions of the shaft seals 122 from the rear side.

Then, as shown in FIG. 9, the seal member 117 is adhered to the frame 31. When adhering the seal member 117 to the frame 31, filling agent 99 is first filled in the recess parts 100 (refer to FIG. 6B).

The filling agent 99 may include moisture curing-type acryl denaturalized silicon resin, which is cured by moisture in air, for example. In addition, the type of the filling agent 99 may be paste or viscous.

When filling the filling agent 99 into the recess parts 100, the filling agent 99 is injected into the recess parts 100.

Figures 6A, 6B:
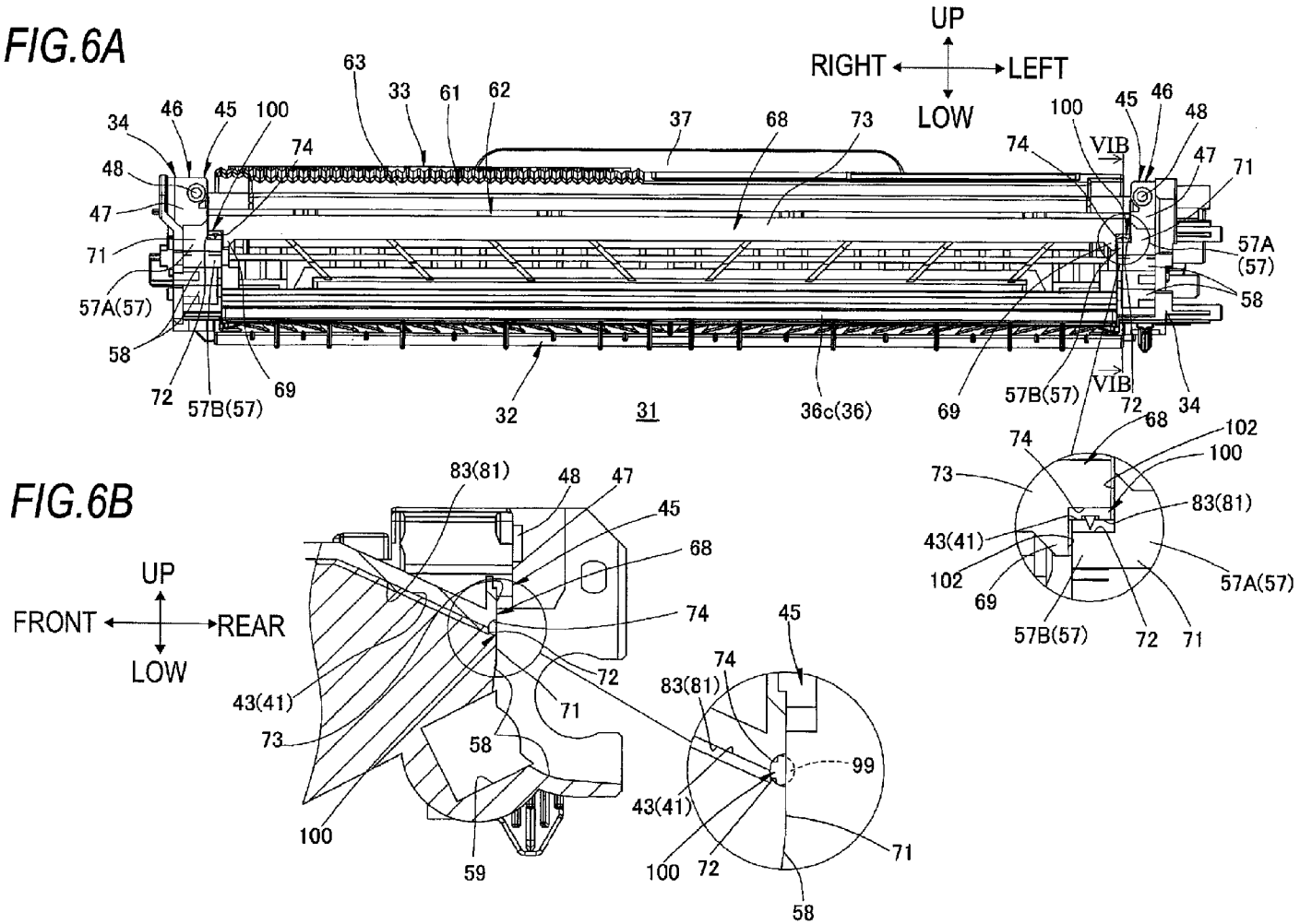
FIG. 6A is a rear view and FIG. 6B is a sectional view taken along a line VIB-VIB.

At this time, the filling agent 99 is injected so as to slightly overflow from the recess parts 100 (refer to FIG. 6B). The overflowed filling agent 99 is introduced into the acceptance recesses 102 from the recess parts 100. The filling agent 99 introduced into the acceptance recesses 102 are kept in the acceptance recesses 102.

Then, the seal member 117 is adhered to the first adhesion surfaces 71 and the second adhesion surface 73 from the rear side so that the central seal part 117A covers the second adhesion surface 73 and the end seal parts 117B cover the recess parts 100 and the first adhesion surfaces 71. In other words, the seal member 117 covers the rear end portions at opposite parts, where the first welding surface 41 and the second welding surface 81 are disposed opposite to one another, from the rear side at the end seal parts 117B. In addition, the filling agent 99 is filled between the rear end portions at the opposite parts and the seal member 117.

Thus, a part between the first adhesion part 57 and the second adhesion part 58 is sealed by the filling agent 99 and the end seal parts 117B.

Then, as shown in FIG. 2, the layer thickness regulating blade 24 is assembled to the frame 31.

For assembling the layer thickness regulating blade 24 to the frame 31, the layer thickness regulating blade 24 is positioned with respect to the frame 31 so that the blade positioning bosses 48 of the first frame 32 are fitted into attachment holes (not shown) of the layer thickness regulating blade 24, and then the layer thickness regulating blade 24 is assembled to the frame 31 from the rear.

As a result, the blade positioning bosses 48 of the first frame 32 are fitted into the attachment holes (not shown) of the layer thickness regulating blade 24, and thus the layer thickness regulating blade 24 is assembled to the frame 31.

Then, when the screws 101 are engaged to the blade positioning bosses 48, the layer thickness regulating blade 24 is fixed to the frame 31.

At this time, the seal member 117 is compressed from the rear side toward the front side by the layer thickness regulating blade 24. Thereby, the layer thickness regulating blade 24 and the seal adhesion part 68 of the second frame 33 are sealed therebetween by the seal member 117.

Then, both end portions in the left-right direction of the developing roller shaft 50 are inserted into the developing roller support recesses 49 from the inner sides in the left-right direction, respectively, so that the developing roller 22 is arranged at the developing roller support part 40.

As a result, the peripheral surface of the developing roller 22 is contacted to the lower end portion of the blade member 91 from the rear side. In addition, both end portions in the left-right direction of the developing roller 22 are contacted to the side seals 118 from the rear side. In other words, both end portions in the left-right direction of the developing roller 22 are opposite to the first adhesion surfaces 71 in the front-rear direction. In the meantime, at this time, both end portions in the left-right direction of the developing roller shaft 50 protrude more outward than both sidewalls 34 of the frame 31.

Then, the bearing members 114 are respectively assembled to the rear end portions of the frame 31 from both outer sides in the left-right direction so that the collar parts 116 are fitted to both end portions in the left-right direction of the developing roller shaft 50.

As a result, both end portions in the left-right direction of the developing roller shaft 50 are rotatably supported to the collar parts 116 and the developing roller 22 is press-contacted to the blade member 91 of the layer thickness regulating blade 24. In addition, the developing roller 22 is press-contacted to the side seals 118, so that both end portions in the left-right direction of the developing roller 22 and the frame 31 are sealed therebetween.

Then, toner is filled into the toner accommodating part 38 through the toner filling opening 119 and the toner filling opening 119 is hermetically sealed by the cap 120, so that the toner is enclosed in the toner accommodating part 38.

4. Operational Effects (1) According to the printer 1, the first frame 32 and the second frame 33 are welded so that the first welding surface 41 and the second welding surface 81 are opposite to each other, as shown in FIGS. 5 and 9.

The seal member 117 is adhered to the first adhesion surfaces 71 and the second adhesion surface 73 to cover the rear end portions at the opposite parts, at which the first welding surface 41 and the second welding surface 81 are disposed opposite to one another, from the rear side. At this time, the filling agent 99 is filled between the seal member 117 and the rear end portions of the opposite parts, at which the first welding surface 41 and the second welding surface 81 are opposite.

Therefore, after welding the first welding surface 41 and the second welding surface 81, it is possible to provide the filling agent 99 between the seal member 117 and the rear end portions at the opposite parts.

Thereby, it is possible to securely provide the filling agent 99 between the seal member 117 and the rear end portions at the opposite parts of the first welding surface 41 and the second welding surface 81 and to securely seal the seal member 117 and the rear end portions at the opposite parts of the first welding surface 41 and the second welding surface 81.

As a result, it is possible to securely seal the rear end portions of the welding surfaces (the first welding surface 41 and the second welding surface 81) of the first frame 32 and the second frame 33.

(2) In addition, according to the printer 1, the first notch portions 72 are formed at parts, at which the first welding surface 41 and the first adhesion surfaces 71 are continuous, and the second notch portions 74 are formed at parts, at which the second welding surface 81 and the second adhesion surface 73 are continuous, as shown in FIG. 5.

The filling agent 99 is filled in the recess parts 100 that are formed by facing the first notch portions 72 and the second notch portions 74.

Accordingly, it is possible to securely seal the opposite parts, at which the first welding surface 41 and the second welding surface 81 are opposite, by the filling agent 99.

(3) Additionally, according to the printer 1, the recess parts 100 accepts the melted support part-side welding ribs 86 being flowed therein.

Therefore, it is possible to hold the melted support part-side welding ribs 86 in the recess parts 100 and to suppress the melted support part-side welding ribs 86 from protruding more rearward than the first adhesion surfaces 71 and the second adhesion surface 73.

As a result, it is possible to suppress the support part-side welding ribs 86 from contacting the seal member 117 and to securely adhere the seal member 117 to the first adhesion surfaces 71 and the second adhesion surface 73.

(4) Further, according to the printer 1, the second frame 33 includes the damming portions 69 that protrude downward from the lower ends of the second adhesion parts 68 at the inner sides in the left-right direction of the second notch portions 74 to direct toward the first frame 32, as shown in FIG. 6A.

Therefore, it is possible to block the inner end portions in the left-right direction of the recess parts 100 by the damming portions 69, so that it is possible to prevent the filling agent 99 from being leaked from the recess parts 100 to the inner sides in the left-right direction.

(5) In addition, according to the printer 1, both end portions in the left-right direction of the reinforcement part 67 and the blade fixing parts 46 form the acceptance recesses 102 that communicates with the outer end portions in the left-right direction of the recess parts 100, and the damming portions 69 and the first adhesion parts 57 form the acceptance recesses 102, that communicates with the inner end portions in the left-right direction of the recess parts 100, as shown in FIG. 6. The filling agent 99 being overflowed from the recess parts 100 is introduced and hold in the acceptance recesses 102.

Accordingly, it is possible to fill the excessive filling agent 99 in the recess parts 100 as the amount of the filling agent kept in the acceptance recesses 102, so that it is possible to securely fill the recess parts 100 with the filling agent. In addition, since it is possible to prevent the filling agent 99 from being splashed from the recess parts 100 to the first adhesion surfaces 71 or second adhesion surface 73, it is possible to securely adhere the seal member 117 to the first adhesion surfaces 71 or second adhesion surface 73.

(6) Further, according to the printer 1, the seal member 117 is adhered to the first adhesion surfaces 71 and the second adhesion surface 73 after the filling agent 99 is filled.

Therefore, it is possible to securely provide the filling agent 99 between the seal member 117 and the opposite parts, where the first welding surface 41 and the second welding surface 81 are disposed opposite one another.

5. Modified Aspects

In the above illustrative aspect, the damming portions 69, which are arranged adjacent to the inner sides in the left-right direction of the second notch portions 74 and protrude downward from the lower ends of the second adhesion parts 68, are provided to the second frame 33, as shown in FIG. 6.

Figure 10:
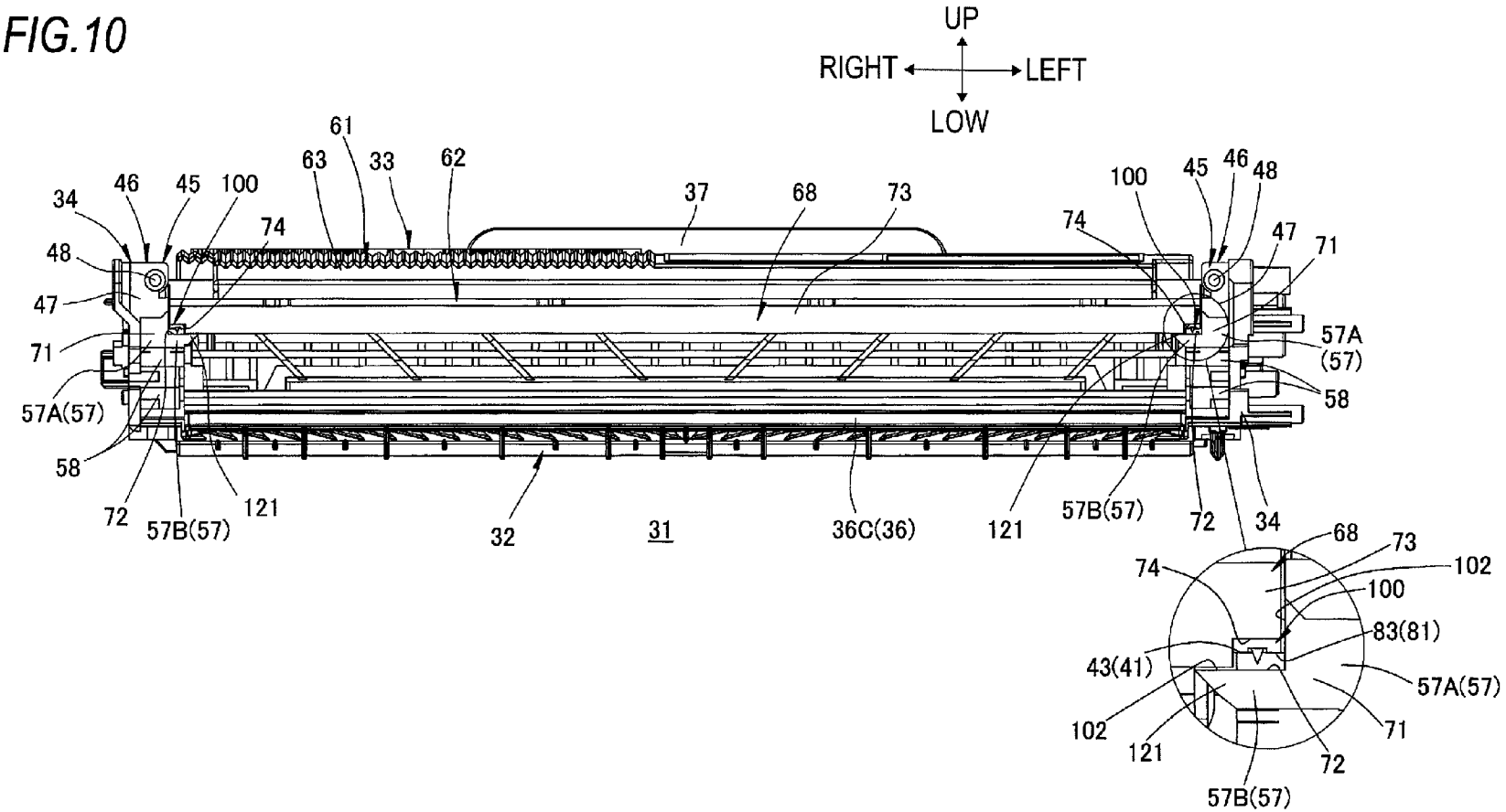
FIG. 10 illustrates a modified aspect of the developing cartridge.

However, as shown in FIG. 10, damming portions 121, which are arranged adjacent to the inner sides in the left-right direction of the first notch portions 72 and protrude from the inner surfaces in the left-right direction of the sidewalls 34 toward the inner sides in the left-right direction, may be provided to the first frame 32 without providing the damming portions 69 to the second frame 33, as shown in FIG. 10.

In this case, the damming portions 121 and the first adhesion parts 57 form the acceptance recesses 102, which communicate with the inner end portions in the left-right direction of the recess parts 100, along the left-right direction.

In the modified aspect, the same effects as the above illustrative aspect can be also achieved.

What is claimed is:

1. A developing device comprising:

a housing; and a developer carrier, which is carrying developer, wherein the housing comprises a first frame and a second frame that is welded to the first frame, wherein the first frame comprises:

a sidewall, which is configured by a pair of sidewalls that face each other with an interval in a longitudinal direction of the developer carrier therebetween, wherein the sidewall extends in an extending direction perpendicular to the longitudinal direction and in a direction from the first frame to the second frame, wherein an orthogonal direction is perpendicular to both the longitudinal direction and the extending direction, and wherein each of three directions has a first side and a second side that is opposite to the first side;

a connection wall configured to be open at both a first side in the extending direction at the sidewalls and a first side in the orthogonal direction at the sidewalls, wherein the connection wall connects a second side end portion in the extending direction at the sidewall and connects a second side end portion in the orthogonal direction at the sidewall, wherein the first frame includes:

a first welding surface that is to be welded to the second frame, wherein the first welding surface is configured to extend to a first side end portion in the orthogonal direction at the sidewall and is continuously formed on a first side end surface in the extending direction at the sidewalls and a first side end surface in the extending direction at the connection wall that connects the second side end portion in the orthogonal direction at the sidewall; and a first adhesion surface that is continuously formed with a first side end portion in the orthogonal direction at the first welding surface, wherein the first adhesion surface extends in the extending direction and is opposite to the developer carrier in the orthogonal direction, wherein the second frame includes:

a second welding surface that is formed to correspond to the first welding surface and is to be welded to the first welding surface; and a second adhesion surface that is continuously formed with a first side end portion in the orthogonal direction at the second welding surface, and wherein the second adhesion surface is substantially flush with the first adhesion surface when the second frame is welded to the first frame, and wherein the first frame and the second frame are welded so that the first welding surface and the second welding surface are opposite to each other in the extending direction, and wherein the developing device further comprises:

a seal member that is adhered to the first adhesion surface and the second adhesion surface, wherein the seal member covers a first side end portion from the first side in the orthogonal direction at an opposite part where the first welding surface and the second welding surface are disposed opposite one another; and a filling agent that is filled between the seal member and the first side end portion in the orthogonal direction at the opposite part, the filling agent being a moisture curing-type acryl denaturalized silicon resin, which is cured by moisture in air.

2. The developing device according to claim 1, wherein the first frame includes a first notch portion that is notched from the first adhesion surface toward the second side in the orthogonal direction at a portion at which the first welding surface and the first adhesion surface are continuous, wherein the second frame includes a second notch portion that is notched from the second adhesion surface toward the second side in the orthogonal direction at a portion at which the second welding surface and the second adhesion surface are continuous, wherein the second notch portion is disposed opposite to the first notch portion when the second frame is welded to the first frame, and wherein the filling agent is filled in a recess part that is formed when the first notch portion and the second notch portion face each other.

3. The developing device according to claim 2, wherein a welding rib is provided at the first welding surface or the second welding surface to weld the first welding surface and the second welding surface, wherein when the first welding surface and the second welding surface are welded, the welding rib is melted and then solidified again to adhere the first welding surface and the second welding surface, and wherein the recess part accepts the melted welding rib which has flowed therein.

4. The developing device according to claim 2, wherein a damming portion is provided on the second frame, and wherein the damming portion is arranged adjacent to an inner side of the second notch portion in the longitudinal direction and protrudes to the second side in the extending direction toward the first frame.

5. The developing device according to claim 2, wherein a damming portion is provided on the first frame, and wherein the damming portion is arranged adjacent to an inner side of the first notch portion in the longitudinal direction and protrudes from an inner surface in the longitudinal direction of the sidewall toward an inner side in the longitudinal direction.

6. The developing device according to claim 2, wherein, an acceptance recess is formed between the first side end portion in the orthogonal direction at the first frame and the first side end portion in the orthogonal direction at the second frame, when the first frame and the second frame are welded, and wherein the acceptance recess accepts the filling agent which has flowed therein and communicates with the recess part to keep the filling agent therein.

7. The developing device according to claim 1, wherein the seal member is adhered to the first adhesion surface and the second adhesion surface, after the filling agent is filled.

8. A developing device comprising:

a developer carrier configured to carry developer and having an axis extending in an axial direction;

a first frame including:

a first sidewall having a first welding surface, a first adhesion surface, a first notch surface connecting the first welding surface and the first adhesion surface, a second sidewall facing the first sidewall in the axial direction of the developer carrier, a connection wall connecting the first sidewall and the second sidewall;

a second frame including:

a second welding surface which is in contact with the first welding surface, a second adhesion surface, and a second notch surface which connects the second welding surface and the second adhesion surface;

a seal member which is in contact with both the first adhesion surface and the second adhesion surface; and a filling agent, which is in contact with the first notch surface, the second notch surface, and the seal member, the filling agent being a moisture curing-type acryl denaturalized silicon resin, which is cured by moisture in air, wherein the first adhesion surface is disposed in a virtual plane which has the second adhesion surface.

9. The developing device according to claim 8, wherein the first notch surface and the second notch surface form a single notch portion having an arc shape as viewed from the axial direction of the developer carrier.

10. The developing device according to claim 8, wherein the first notch surface and the second notch surface respectively have an arc shape as viewed from the axial direction of the developer carrier.

11. The developing device according to claim 8, further comprising:

a housing configured by the first frame and the second frame; and a layer thickness regulating blade, wherein the seal member is provided between the housing and the layer thickness regulating blade.

* * * * *